United States Patent [19]

Renger

[11] 4,379,010

[45] Apr. 5, 1983

[54] METHOD FOR MAKING FLYING SURFACES

[75] Inventor: Larry H. Renger, Hawaiian Gardens, Calif.

[73] Assignee: Mattel, Inc., Hawthorne, Calif.

[21] Appl. No.: 316,623

[22] Filed: Oct. 30, 1981

[51] Int. Cl.[3] ..... B60J 1/00; B32B 31/00; A63H 27/00

[52] U.S. Cl. ..... 156/108; 156/252; 156/256; 156/263; 156/300; 46/76 R; 156/196

[58] Field of Search ..... 156/256, 263, 267, 264, 156/300, 108, 196, 252, 280; 46/77, 79, 80, 81, 76 R; 244/154, 123; 434/372

[56] References Cited

U.S. PATENT DOCUMENTS 4,122,626 10/1978 Waters ..... 46/79

FOREIGN PATENT DOCUMENTS 483018 4/1938 United Kingdom ..... 244/154

OTHER PUBLICATIONS

American Modeler, "Sketchbook", vol. 52, No. 2, May 1959, p. 37.

*Primary Examiner*—Edward C. Kimlin
*Assistant Examiner*—Louis Falasco
*Attorney, Agent, or Firm*—Reagin & King

[57] ABSTRACT

A method of making flying surfaces is disclosed which employs a panel of foam plastic to form a one piece frame. A plurality of apertures are die cut in the panel to establish the desired interior shape of the frame. One side of the panel is coated with an adhesive. A sheet of thin plastic film material is applied over the adhesive to cover the surface of the panel. Shapes in the form of the desired outline of the flying surface are cut out of the panel. The size of the panel is chosen so that a multitude of flying surfaces may be produced simultaneously.

12 Claims, 5 Drawing Figures

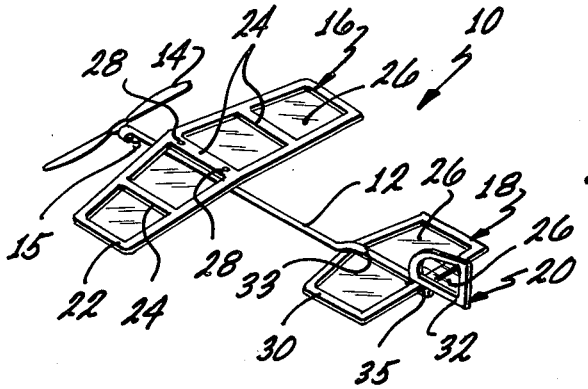
FIG. 1
FIG. 2
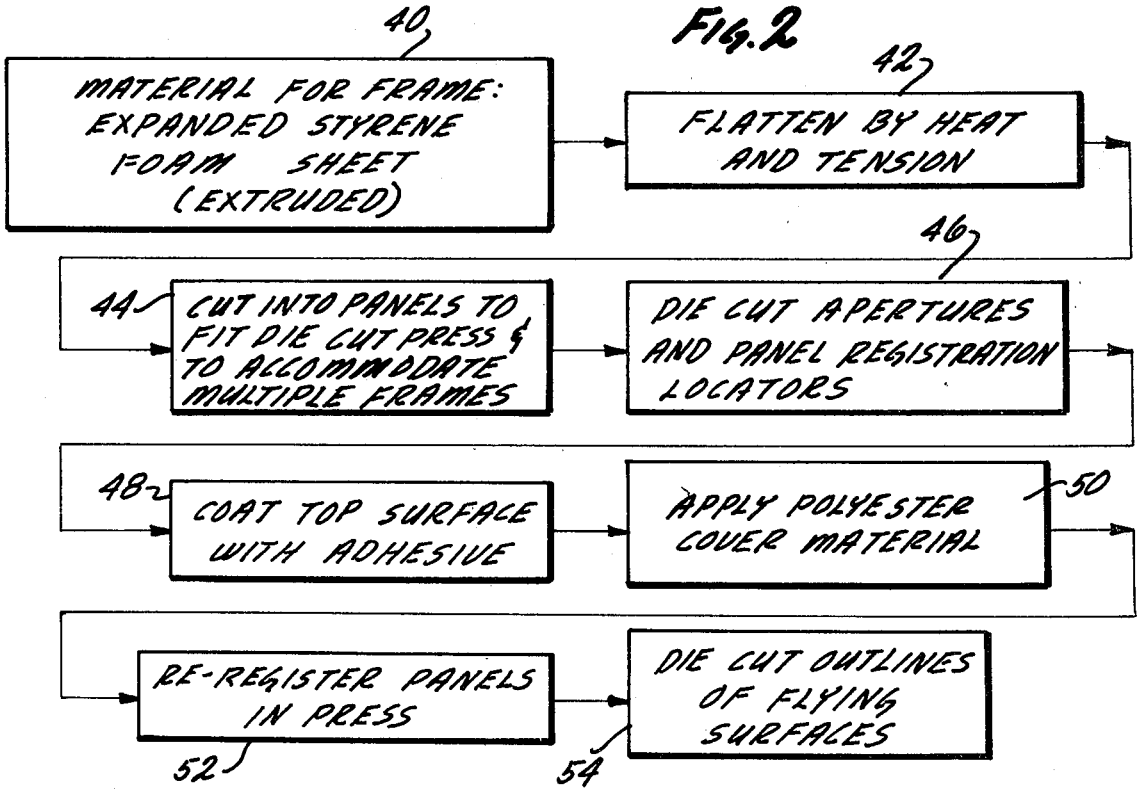

METHOD FOR MAKING FLYING SURFACES

BACKGROUND OF THE INVENTION

This invention relates to methods of making flying surfaces and more particularly, to a method of making flying surfaces for model aircraft.

A large variety of model airplanes have been developed over the years. The most successful of these airplanes are designed to remain aloft for long periods of time, which greatly enhances the excitement of playing with model airplanes. Since the minimum forward velocity at which a model airplane will maintain its flying attitude is related to the weight of the craft, lighter craft are able to remain alot for longer periods of time.

The majority of the weight of model airplanes is generally attributable to the large area flying surfaces. Accordingly, prior art designs of model airplanes have evolved to minimize the weight of the flying surfaces. One such design employs thin sheets of a light weight material such as balsa wood to form the various flying surfaces such as the wings, and the horizontal and vertical stabilizers. While flying surfaces formed of balsa wood sheets are relatively easy to construct, they are sufficiently heavy to require a high forward velocity to keep the craft aloft. In addition, balsa wood is relatively expensive, varies in its quality, and is quite fragile.

The weight of a model airplane wing may be reduced by employing a light-weight frame covered by a thin sheet of material, in place of the sheet of balsa wood described above. For example, the use of a frame formed of material such as balsa wood and covered with a thin sheet of paper to form an airplane wing is disclosed in U.S. Pat. No. 1,893,791, issued Jan. 10, 1933 to G. D. Warner, and in U.S. Pat. No. 2,161,921, issued June 13, 1939 to Carl Fritzen. In each of these references, the frame is assembled of a plurality of segments or struts which are fastened together to form the outer shape of the flying surface. A sheet of paper is fastened across the struts to complete the wing.

Forming the frame of the wing requires a great deal of assembly time to ensure proper shape and alignment and precludes the use of mass production techniques to manufacture the wing. Further, fastening a sheet of paper to an individual frame also requires a great deal of assembly time to ensure that the paper forms a smooth flying surface. In addition, the paper must be carefully trimmed to conform to the outline of the frame.

It is therefore an object of the present invention to provide a new and improved method of making flying surfaces.

It is another object of the present invention to provide a method of inexpensively mass producing light weight flying surfaces for use with model airplanes.

SUMMARY OF THE INVENTION

The foregoing and other objects of the invention are accomplished by employing a panel of stiff, light weight plastic material such as expanded styrene foam to form a one-piece frame of a flying surface, such as the wing member or stabilizer of a model airplane. A plurality of apertures are formed in the panel by means such as die cutting, to establish the desired interior shape of the frame. The size of the panel is chosen so that a multitude of flying surface frames may be produced simultaneously.

After the apertures have been formed, one side of the panel is coated with an adhesive which may be applied by spraying or rolling. A sheet of thin plastic film material such as polyester is placed onto the adhesive coated surface of the panel by means such as rolling, so that the polyester film covers all of the apertures. Shapes in the form of the desired outline of the flying surface are then cut out of the panel observing proper registration relative to the apertures. The result is a completely assembled flying surface having a one-piece, light weight frame covered with a thin plastic film.

Other objects, features and advantages of the invention will become apparent by reference to the specification taken in conjunction with the drawings in which like elements are referred to by like reference designations throughout the several views.

BRIEF DESCRIPTION OF THE DRAWINGS

FIG. 1 is a perspective view showing a model airplane employing flying surfaces constructed in accordance with the method of the present invention;

FIG. 2 is a block diagram showing the various steps of the method of the present invention;

DESCRIPTION OF THE PREFERRED EMBODIMENT

Figure 3:
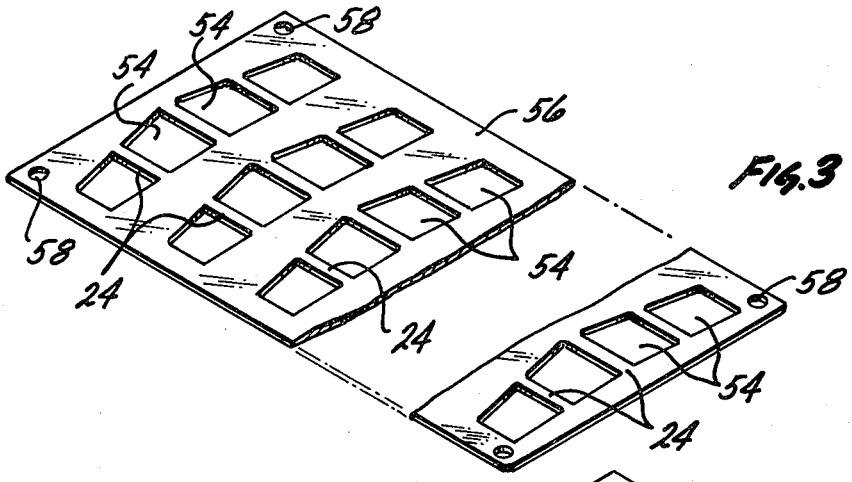
FIG. 3 is a perspective view showing a plurality of apertures formed in a stiff plastic panel to fabricate the wings of the model airplane of FIG. 1 in accordance with the method of the present invention.

Referring to FIG. 1, there is shown a model airplane 10 including a fuselage 12, a propeller 14, a wing member 16, a horizontal stabilizer 18, and a vertical stabilizer 20. The propeller 14 is rotatably mounted to the fuselage 12 and is driven by means such as a rubber band (not shown) one end of which may be connected to a hook 15 carried by the propeller 14. The fuselage is in the shape of an elongated bar and is formed of a rigid plastic material such as polystyrene.

The wing member 16 includes a one-piece frame 22 shaped to form the desired wing outline, and having spaced apart ribs 24 to increase the rigidity of the frame 22. The entire upper surface of the wing member 16 is covered with a thin film of plastic material 26 such as polyester to form a smooth flying surface. The frame 22 is formed of a light-weight, stiff plastic material such as expanded styrene foam having a thickness of from one to four millimeters, depending on the wing span. The wing member 16 is mounted to the fuselage 12 using slots 28 (formed in the central rib 24) which tightly engage with mating struts extending from the top surface of the fuselage 12.

The horizontal and vertical stabilizer 18 and 20 are constructed of similar materials and in a similar manner to the wing member 16 described above. Hence, the stabilizers 18 and 20 include one-piece frames 30 and 32, respectively, one surface of each of which is covered by a thin film of plastic material 26. A slot 33 is provided at the rear of the fuselage 12 to mount the horizontal stabilizer 18 thereto. A slot 35 is also provided in the vertical stabilizer 20 to mount it to the horizontal stabilizer 18 as shown in FIG. 1.

FIG. 2 is a block diagram showing the various steps employed in the method of the present invention to form the flying surfaces 16, 18, and 20 described above. By way of example, the construction of the wing member 16 is used to illustrate the method of the present invention in the following description. However, the method described is by no means limited to the construction of the wing member 16, and is equally applicable to the construction of the stabilizers 18 and 20 as well as similar flying surfaces including propeller blades and helicopter rotors, as will become apparent to the reader.

Referring to block 40 in FIG. 2, the starting material used to form the frame 22 is an expanded styrene foam extruded onto a roll in the form of a continuous sheet. The sheets employed in the present application are typically 56 centimeters wide and range in weight from 15.7 to 22.5 kilograms per 90 square meters of sheet area. Typical foam sheets of this type are manufactured by Huntsman Container Co., Fullerton, Calif. Because the foam sheet is extruded onto a roll, the sheet possesses a certain amount of curl. The sheet may be flattened to eliminate the curl by supporting the sheet under tension and heating the sheet until it is flat, as shown in block 42 of FIG. 2. The procedures used to extrude and flatten styrene foam sheets as described above are well known to those skilled in the plastics art, and are not described in detail.

After the foam sheet has been flattened, it is cut into generally rectangular panels having a length of approximately 1.2 meters. The length of the panel is chosen large enough to accomodate a multitude of wing frames and yet small enough to fit within the die cut press. Referring to FIG. 3 and block 46 of FIG. 2, multiple sets of apertures 54 are formed in the panel 56 by means such as die cutting. Each set of four such apertures 54 define the interior shape of the frame 22 of one wing member 16, including the ribs 24. In the same cutting operation panel locator holes 58 are provided around the periphery of the panel 56.

Figure 4:
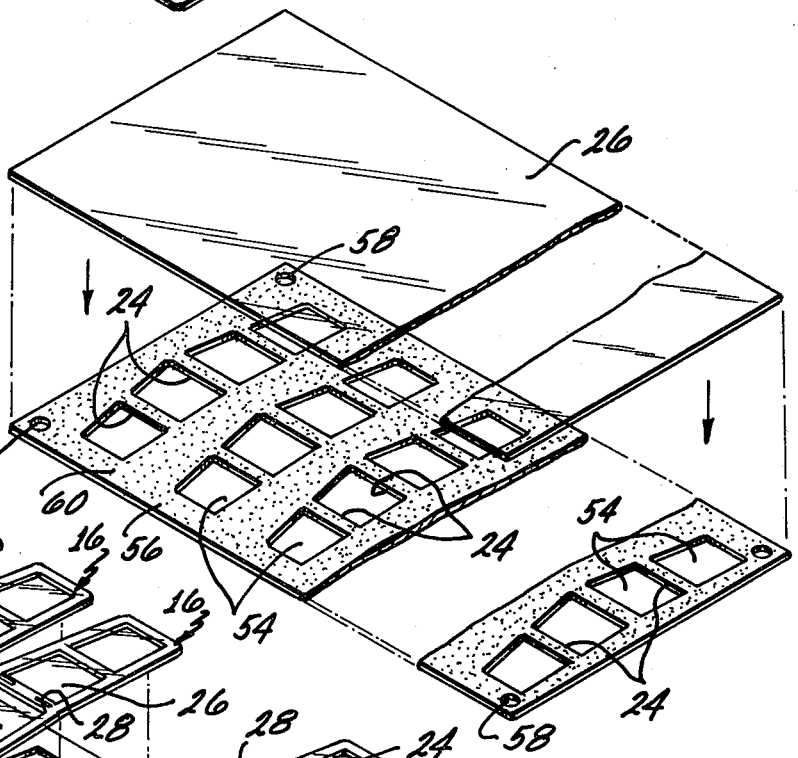
FIG. 4 is a perspective view showing the application of a sheet of thin plastic film to one surface of the panel of FIG. 3.

Referring to FIG. 4 and blocks 48 and 50 of FIG. 2, one surface of the panel 56 of FIG. 3 may be coated with an adhesive 60 which may be sprayed or rolled on to form a thin film. A typical adhesive is type 777, manufactured by Eastman Kodak. A sheet 26 of thin plastic film is then applied to the panel 56 over the adhesive 60. The plastic sheet 26 is typically formed of polyester film such as Mylar, manufactured by Dupont Corporation, and having a thickness of one quarter of a mil. (0.00025 inches). The preferred method of applying the sheet 26 is to roll it onto the panel 56 under tension so that it forms a smooth covering surface. An alternating method of providing the adhesive 60 is to apply it to the plastic sheet 26 instead of the panel 56. The adhesive 60 may also be of the heat activated type.

Figure 5:
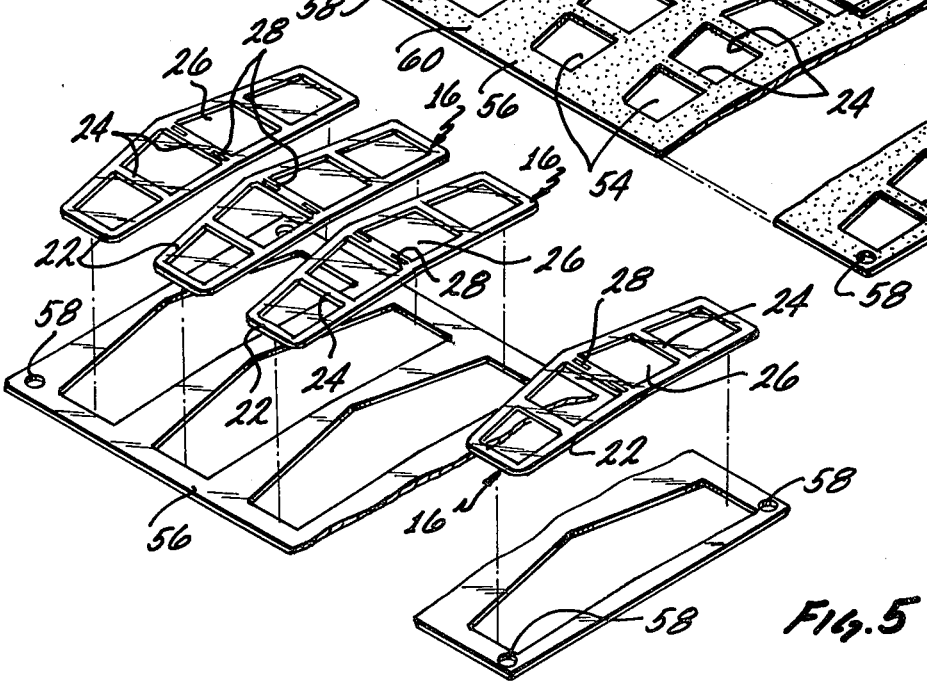
FIG. 5 is a perspective view showing completed model airplane wings produced from the assembly of FIG. 4.

Referring to FIG. 5 and blocks 52 and 54 of FIG. 2, the assembly of FIG. 4 is placed into a die cutting press, with the locator holes 58 providing accurate registration of the panel 56 within the press. The press is used to cut out multiple shapes each in the form of the outline of the wing member 16 as well as to form the mounting slots 28 in the center rib 24 of each frame 22, as shown in FIG. 5. This cutting operation, in conjunction with the apertures 54 provided in the previous cutting operation, forms the frame 22 and trims the thin sheet 26 to the outline of the frame 22. The resultant wing members 16 require no further assembly operations and are ready to be assembled to the fuselage 12 to form the model airplane 10 shown in FIG. 1. From the above description of the method of the present invention, it can be seen that this method may easily be adapted to produce the stabilizers 18 and 20 of the airplane 10 by simply changing the shapes of the cutting dies to produce the desired stabilizer forms. Further, the weight of the foam material used to form each of the flying surfaces may be chosen to be different for each surface to optimize performance of the craft.

The flying surfaces produced by the method of the present invention require no further construction by the user, are light in weight, and are extremely uniform in construction. The disclosed method is directly adaptable to inexpensive mass production of flying surfaces. In particular, the production of multiple flying surfaces from a single panel provides a significant manufacturing economy. Using the method of the present invention, wing members 16 having a span of twenty six centimeters have been produced which weigh less than one gram. Model airplanes constructed with these wing members are capable of remaining in flight at forward velocities as low as three meters per second.

The foam plastic used to form the frame of the wing member 16 is sufficiently stiff to maintain the shape of the wing, while at the same time being sufficiently compliant to permit the user to alter the shape of the wing member by bending or curving the frame. It is well known to those skilled in the art that such alterations to the wing shape modify the flight pattern of the airplane. In particular, it is desirable to provide a gentle curve to the wing member to ensure a level flight pattern. A modification of the method of the present invention can be employed to provide this desired curvature to the wing member 16 as follows.

As described above, the expanded styrene foam sheet is initially provided on a roll and possesses a certain amount of curl. Controlling the degree of this curl, e.g., by controlling the size of the rollers used to support the foam sheet, makes it possible to use the curl to provide the desired wing curvature. Thus, by eliminating the flattening step shown in block 42 of FIG. 2, panels 56 which possess the desired wing curvature may be produced from the curled foam sheet. Processing the curved panels thus formed by the method described above produces curved wing members 16 without the need for user adjustments or additional processing steps. The orientation of the curvature of the wing relative to the axis of the wing may also be controlled by choosing the angle at which the panels 56 are cut from the foam sheet with respect to the curl of the sheet.

While there has been shown and described a preferred embodiment, it is to be understood that various other adaptations and modifications may be made within the spirit and scope of the invention. It is thus intended that the invention be limited in scope only by the appended claims.

What is claimed is:

1. A method of making a plurality of flying surfaces each having a relatively stiff frame of light weight plastic covered with a sheet of thin film material, comprising the steps of:

providing a panel formed of the material of which the frame is to be made, and sufficiently large to accommodate the plurality of flying surfaces, the panel having a first surface;

simultaneously forming a plurality of apertures in the panel to define the interior of multiple frames;

providing the sheet of thin film material having a second surface;

applying an adhesive to one of the first and second surfaces;

laminating said sheet of thin film material over said first surface to cover the panel to form a laminated panel; and simultaneously forming a plurality of flying surfaces from the laminated panel which each flying surface includes a plurality of apertures defining the interior surface of a frame member.

2. The method of claim 1 in which the step of providing a panel includes flattening the panel.

3. The method of claim 1 wherein the step of forming a plurality of apertures includes die cutting the panel.

4. The method of claim 1 wherein the step of applying an adhesive includes spraying the adhesive onto one of the first and second surfaces.

5. The method of claim 1 wherein the step of applying an adhesive includes rolling the adhesive onto one of the first and second surfaces.

6. The method of claim 1 wherein the step of laminating the sheet of thin film material includes rolling the sheet onto the first surface of the panel.

7. The method of claim 1 wherein the step of simultaneously forming plurality of flying surfaces includes die cutting the laminated panel.

8. The method of claim 1 in which the step of simultaneously forming a plurality of flying surfaces includes the step of forming slots in a portion of the frame which are used to mount the flying surface to a fuselage of an aircraft.

9. The method of claim 1 in which the step of providing a panel includes curving the panel to form a curved flying surface.

10. The method of claim 1 wherein the panel is formed of expanded plastic foam.

11. The method of claim 1 wherein the step of simultaneously forming a plurality of apertures in the panel includes die cutting the panel both to form the apertures and to form a plurality of registration openings to locate the panel during subsequent operations.

12. The method of claim 11 wherein the step of simultaneously forming a plurality of flying surfaces includes die cutting the laminated panel using the plurality of registration openings to locate the laminated panel during the cutting operation.

* * * * *